US007677137B1

(12) United States Patent
Chen

(10) Patent No.: US 7,677,137 B1
(45) Date of Patent: Mar. 16, 2010

(54) REVERSIBLE RATCHET MECHANISM FOR RATCHET TOOLS

(76) Inventor: Chia-Yu Chen, No. 9, Hou-Chuang 7 Street, Hou-Chuang Li, Peitun District, Taichung City (TW)

( * ) Notice: Subject to any disclaimer, the term of this patent is extended or adjusted under 35 U.S.C. 154(b) by 0 days.

(21) Appl. No.: 12/358,339

(22) Filed: Jan. 23, 2009

(51) Int. Cl.
*B25B 13/46* (2006.01)

(52) U.S. Cl. ..... 81/62; 81/63.1

(58) Field of Classification Search ..... 81/60–63.2
See application file for complete search history.

(56) References Cited

U.S. PATENT DOCUMENTS 2,407,558 A * 9/1946 Kress ..... 81/62
5,752,590 A * 5/1998 Lin ..... 81/63.1
6,260,446 B1 * 7/2001 Hu ..... 81/62
6,902,047 B2 * 6/2005 Ting ..... 81/63.1
7,353,734 B1 * 4/2008 Hu ..... 81/62

* cited by examiner

*Primary Examiner*—Hadi Shakeri
(74) *Attorney, Agent, or Firm*—Ming Chow; Sinorica, LLC

(57) ABSTRACT

A reversible ratchet mechanism for ratchet tools comprises a positioning portion the middle section of which is formed with a concave U groove. Two sides of the U groove are each formed with a receiving groove to which a wedge flake is wedged. An elastic part is provided in the U groove to elastically push open the wedge flakes. A reversible ring is set around the positioning portion, the inner circumference of which is formed with two stoppers that may drive the wedge flakes to turn. A ratchet is set around the positioning portion, the inner side of which is formed with a gear wedging the wedge flakes. Thus, when turning an angle, the reversible ring may drive one of the wedge flakes to release from the gear and thus make the ratchet clutch in a direction.

2 Claims, 12 Drawing Sheets

REVERSIBLE RATCHET MECHANISM FOR RATCHET TOOLS

BACKGROUND OF THE INVENTION

1. Field of the Invention

This invention relates to a reversible ratchet mechanism for ratchet tools.

2. Description of the Related Art

With reference to FIG. 1 as a 3D exploded view, a conventional ratchet screwdriver mainly comprises a positioning mount 10 provided with a joint terminal 11 and a positioning terminal 12 the front side of which is formed with an open slot 13 around which two symmetrical U grooves 14*a* and 14*b* are formed into which wedge tablets 15*a* and 15*b* are each wedged; a U-shaped elastic flake 16 provided in the open slot 13 two free ends of which respectively lean against elastically the opposite inner sides of wedge tablets 15*a* and 15*b*; a reversible ring 20 set around the positioning terminal 12 the inner circumference of which is concave and formed with two wedge slots 21*a* and 21*b* that may lead the wedge tablets 15*a* and 15*b* to run and reverse; and a ratchet 30 set around the positioning terminal 12 the inner side of which is formed with a gear 31 that wedges the driving portions of wedge flakes 15*a* and 15*b*.

Refer to FIGS. 2A, 2B, 3A, and 3B that are shown as sectional views illustrating the middle section and front section of the positioning terminal of conventional ratchet screwdriver. When the reversible ring 20 stay at an initial site, the driving portions of wedge flakes 15*a* and 15*b* are positioned in the wedges slots 21*a* and 21*b*; further, the U-shaped elastic flake elastically leans against the gear 31 of ratchet 30 and thus the ratchet 30 cannot clutch. When the reversible ring 20 counterclockwise runs at an angle, the wedge slot 21*b* leads the wedge flake 15*b* to counterclockwise run by means of a leading inclined plane 23 and be blocked on an inner torus 24 of the reversible ring 20. Thus, the driving portion of wedge flake 15*b* releases from the gear 31 of ratchet 30 to make the ratchet 30 clockwise clutch.

With reference to FIGS. 4A and 4B illustrating manners of reversing the conventional ratchet tool, the leading inclined planes 23 of wedge slots 21*a* and 21*b* rub the driving portions of wedge flakes 15*a* and 15*b*. Working for a long time, the leading inclined plane 23 is worn and damaged. In the embodiment, when the leading inclined plane 23 of wedge slot 21*b*, although the reversible ring 20 lead the wedge flake 15*b* to counterclockwise run, the driving portion is kept off the worn leading inclined plane 25 and thus interferes with and releases from the gear 31 of the ratchet 30.

Consequently, because of the technical defects of described above, the applicant keeps on carving unflaggingly through wholehearted experience and research to develop the present invention, which can effectively improve the defects described above.

SUMMARY OF THE INVENTION

A reversible ratchet mechanism for ratchet tools according to this invention mainly comprises a base. One end of the base is a joint connected to a grab handle, and the other end is a positioning portion the circumference of which is formed with an open slot and an inward concave camber. A U groove is formed in the middle of camber. Receiving grooves are each formed at the left and right sides of U groove. Two wedge flakes are respectively wedged into the receiving grooves. An elastic part is provided in the U groove to elastically push open the wedge flakes. A reversible ring is set around the positioning portion. The inner circumference of reversible ring is formed with two convex triangular stoppers that may drive the wedge flakes to centrally turn at an angle in the receiving grooves. A ratchet is set around the positioning portion and overlap with the reversible ring. A gear is provided at the inner side of ratchet to wedge the driving portion of wedge flake. Thus, the reversible ring directly drives the wedge flake to solve the issue of abrasion of the conventional mechanism and exalt the durability and reliability.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
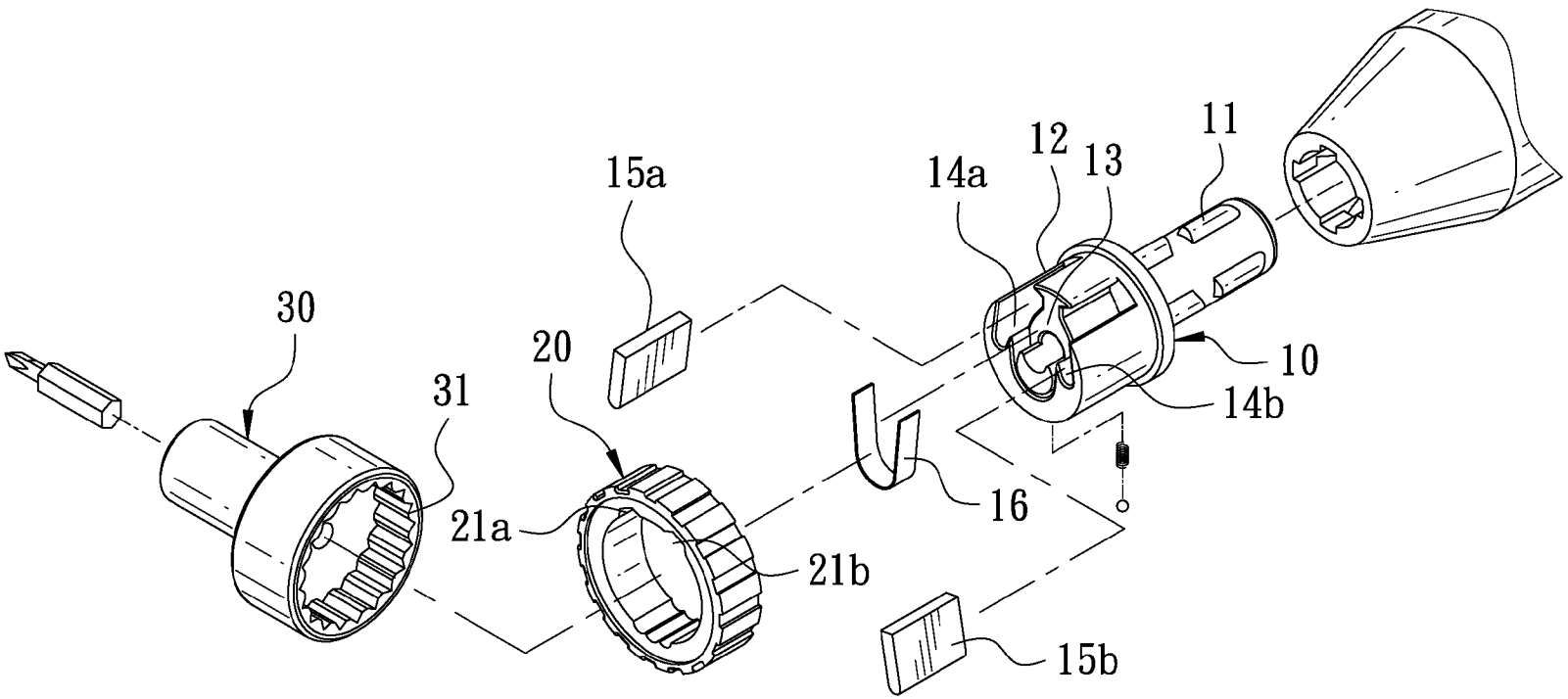
FIG. 1 PRIOR ART
FIG. 1 is a 3D exploded view of a conventional ratchet screwdriver.
Figure 2A:
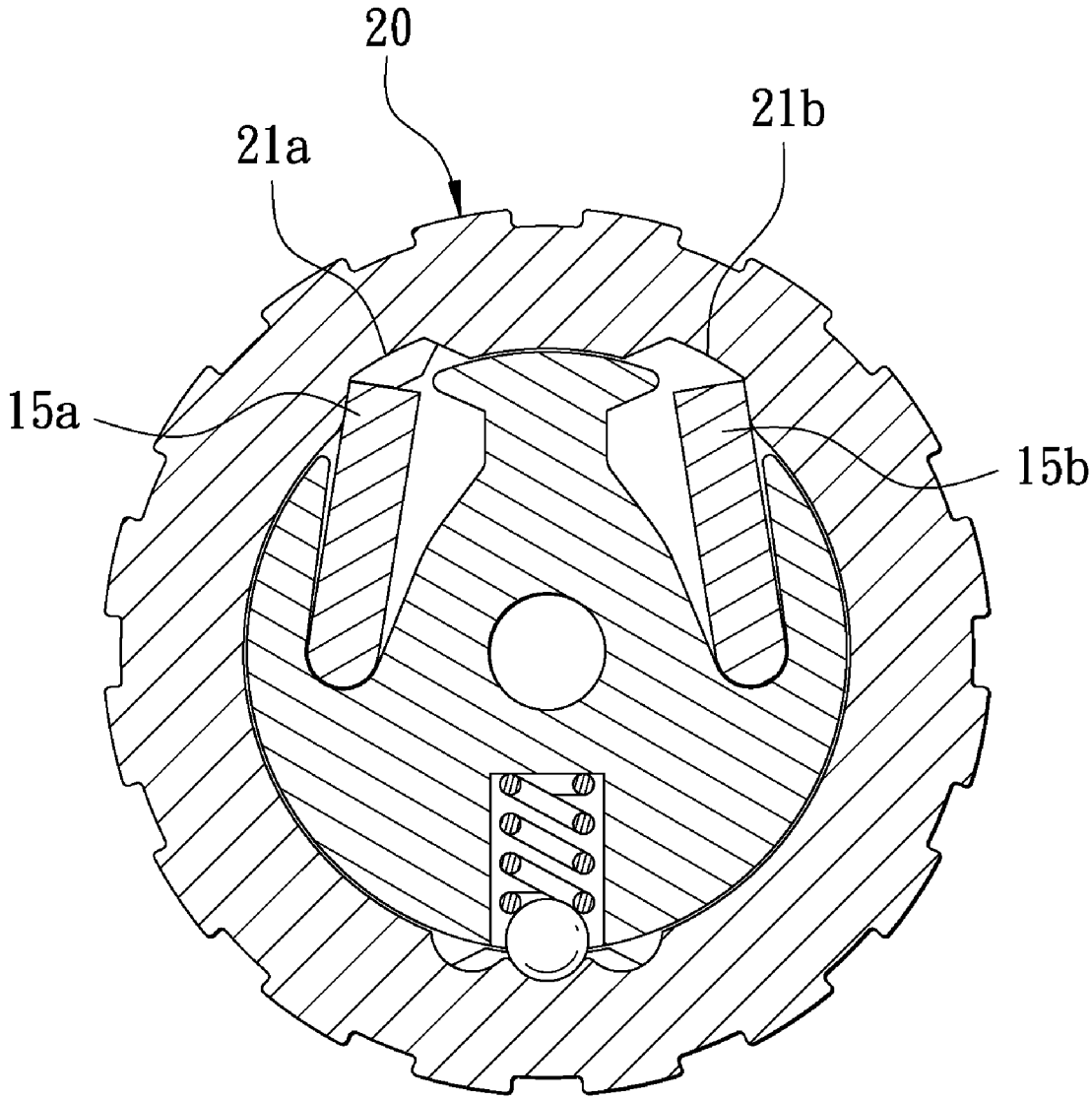
FIG. 2A PRIOR ART
FIGS. 2A and 2B are sectional views of the middle section and front section of the positioning terminal of conventional ratchet screwdriver, illustrating a positioning status before the wedge flakes reverse.
Figure 2B:
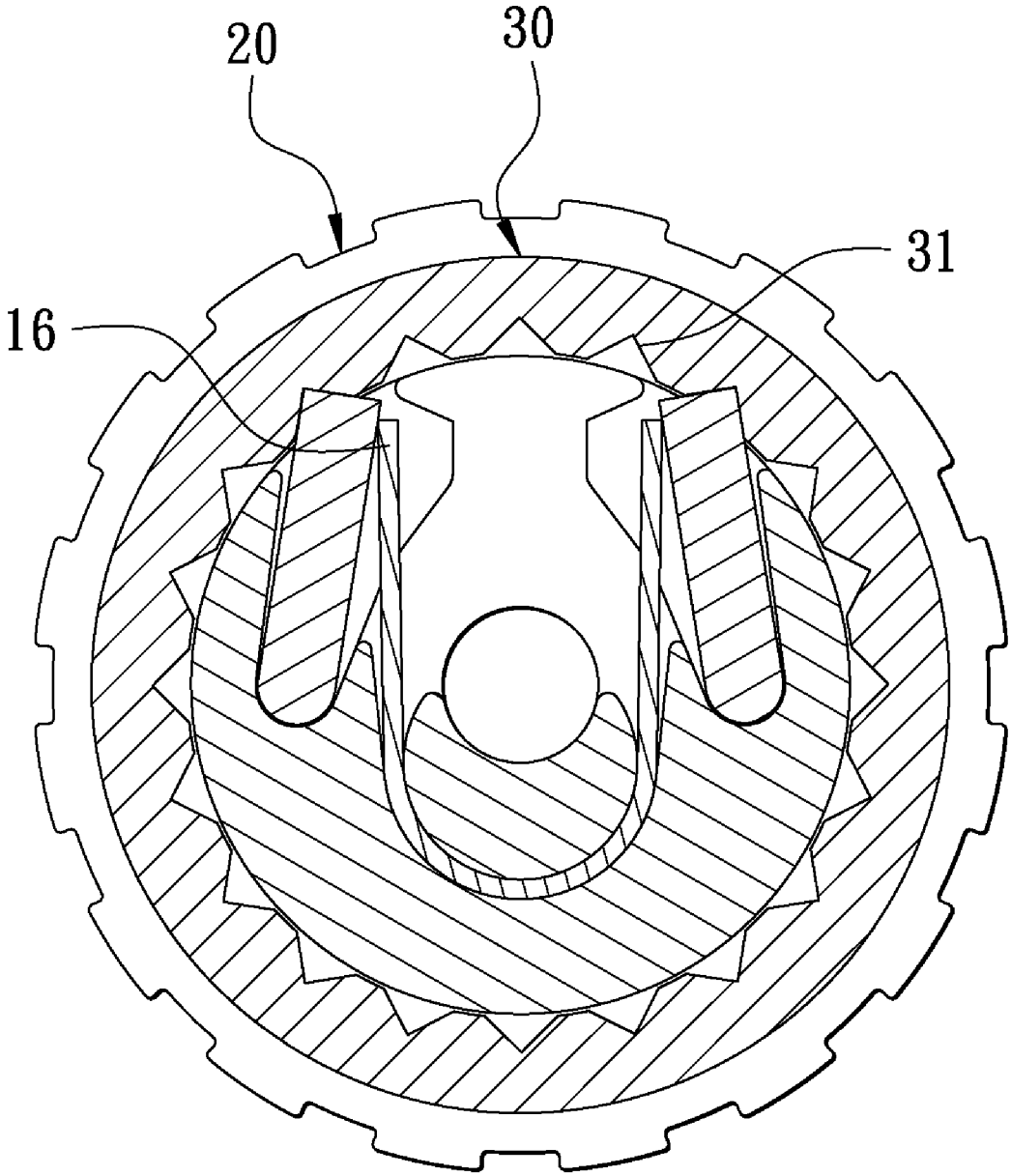
FIG. 2B PRIOR ART
Figure 3A:
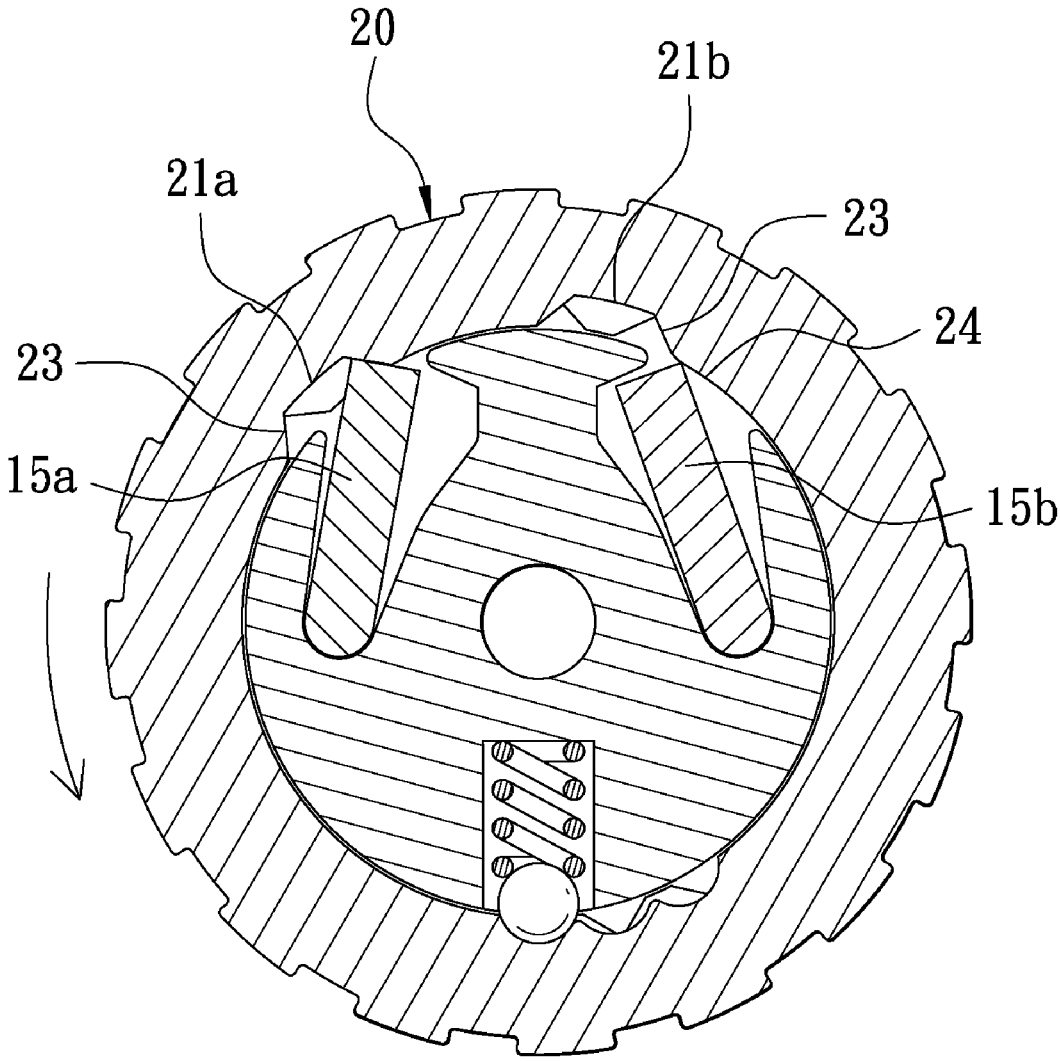
FIG. 3A PRIOR ART
FIGS. 3A and 3B are sectional views of the middle section and front section of the positioning terminal of conventional ratchet screwdriver, illustrating a positioning status after the wedge flakes reverse.
Figure 3B:
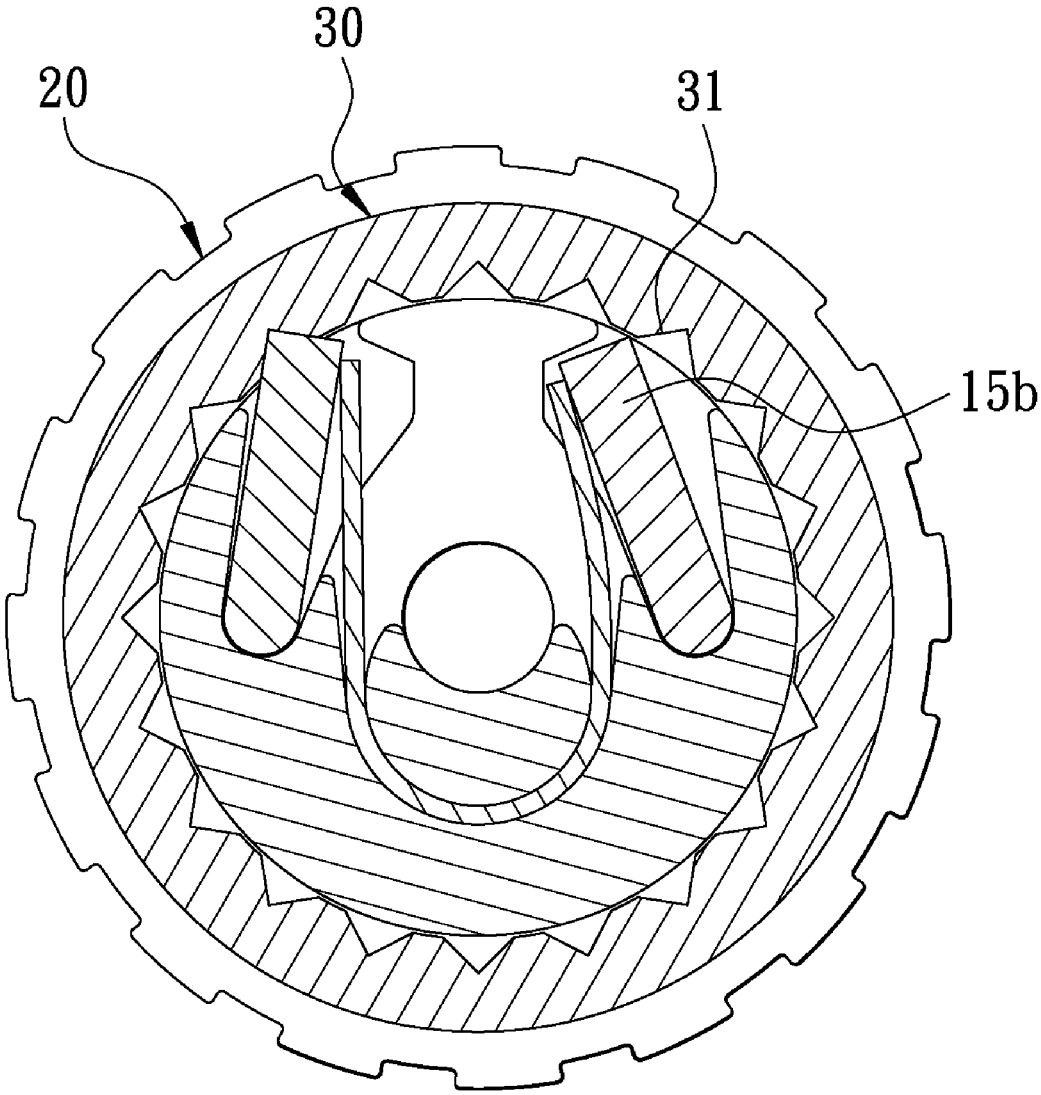
FIG. 3B PRIOR ART
Figure 4A:
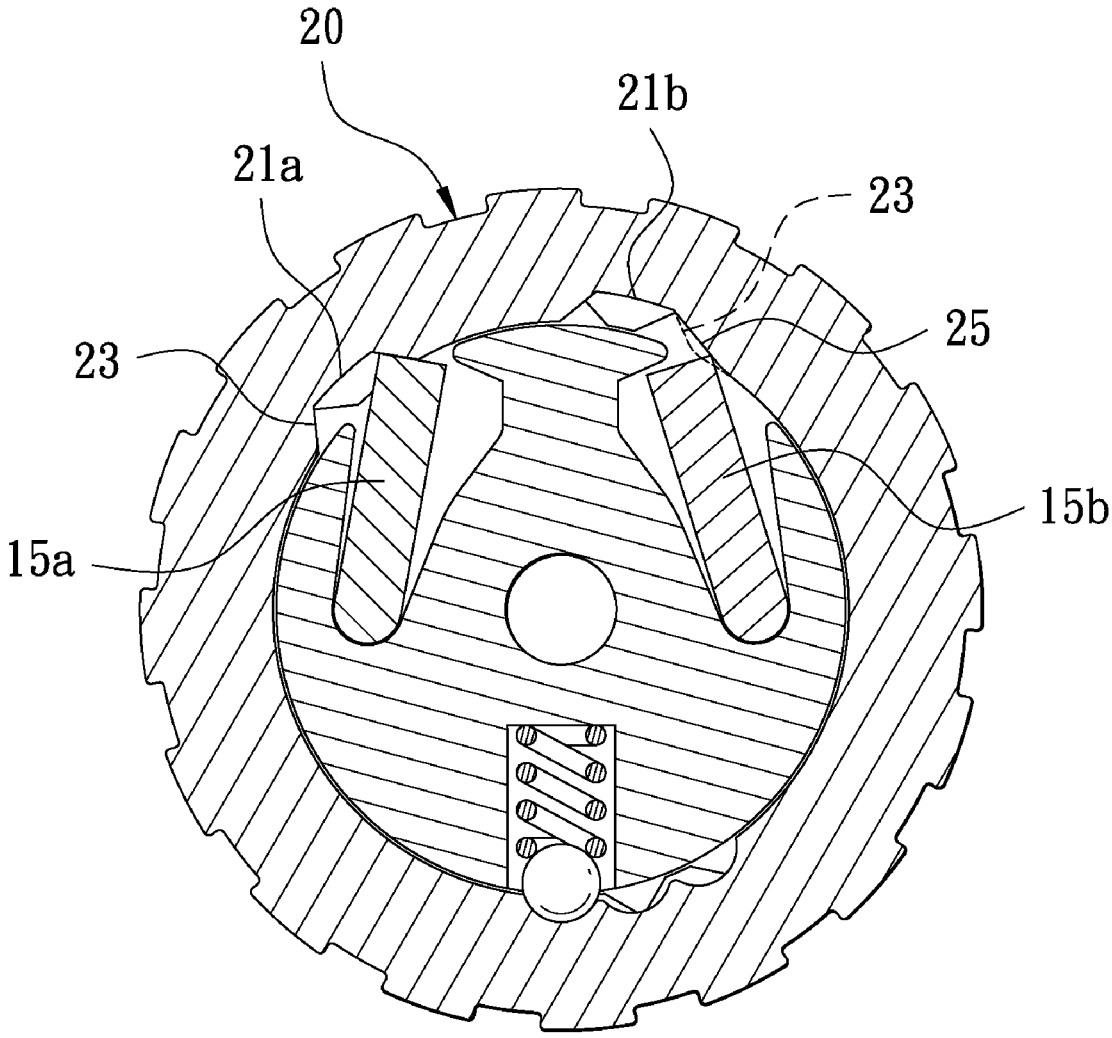
FIG. 4A PRIOR ART
FIGS. 4A and 4B are sectional views of the middle section and front section of the positioning terminal of conventional ratchet screwdriver, illustrating that the ratchet cannot clutch after one of the wedge slots is worn and damaged.
Figure 4B:
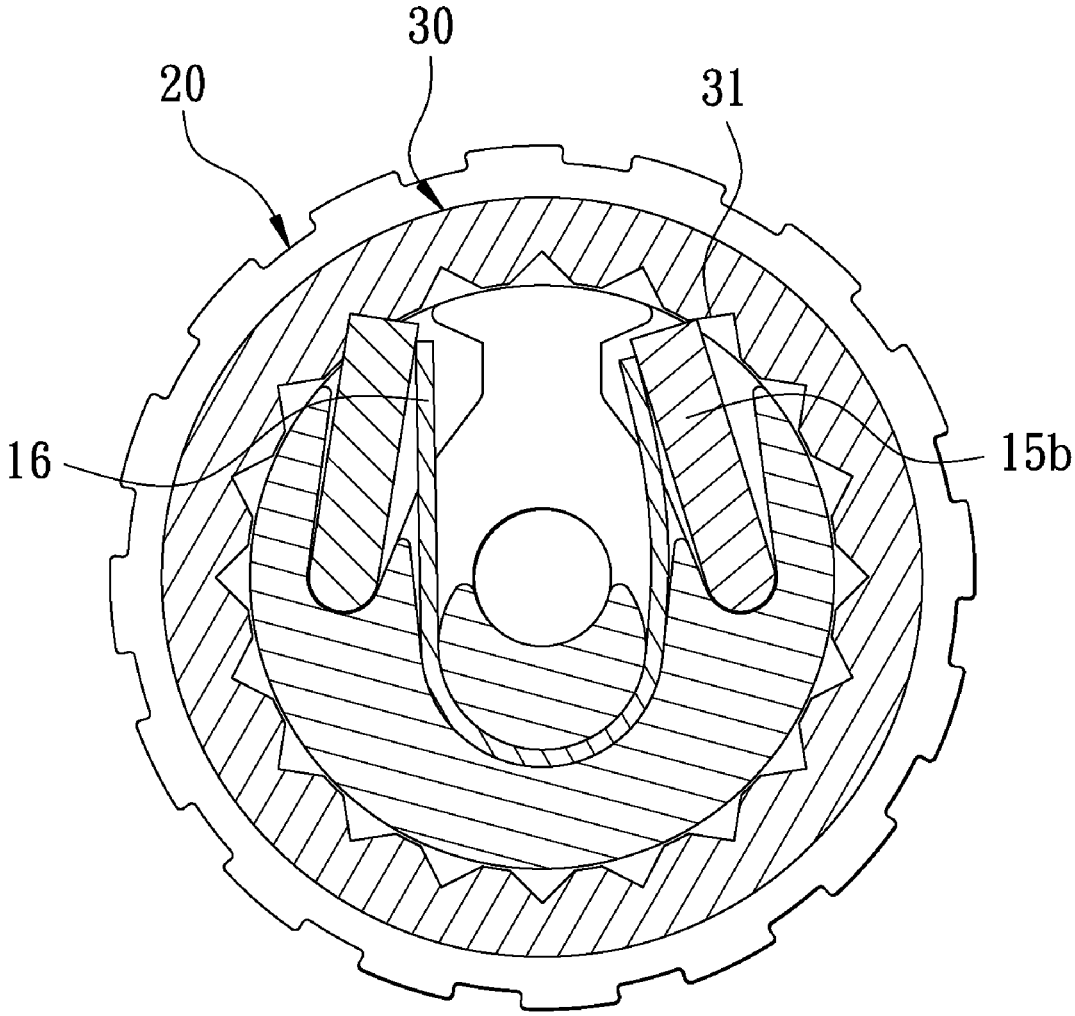
FIG. 4B PRIOR ART
Figure 5:
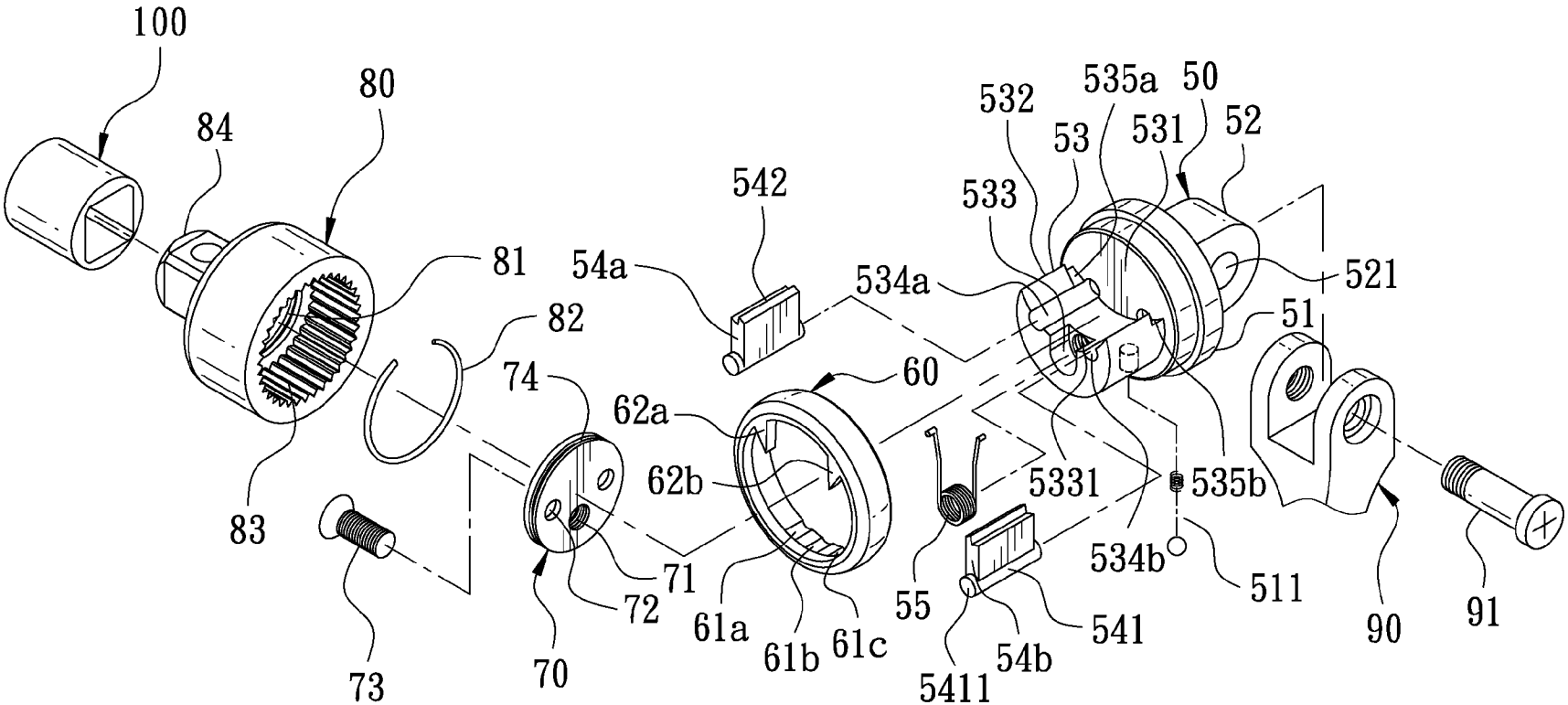
FIG. 5 is a 3D exploded view of a ratchet tool according to this invention.

With reference to FIG. 5 as a 3D exploded view, a reversible ratchet mechanism for ratchet tools according to this invention mainly comprises a base 50, a reversible ring 60, a blind flange 70, and a ratchet 80.

An annular convex flange 51 is provided in the middle section of the circumference of base 50, and a positioning unit 511 is provided around the outer circumference of flange 51. One end of the base 50 is a joint 52 one side of which is formed with a thru hole 521 through which a grab handle 90 is connected with a screw bolt 91; the other end of the base 50 is a positioning portion 53. The circumference of positioning portion 53 is formed with an open slot 531 and an inward concave camber 532. A U groove 533 with a lockhole 5331 is formed in the middle section of camber 532, and receiving grooves 534*a* and 534*b* at the two sides of U groove 533 that are arranged at proper distance of intervals, in which the mouths are open in the same direction as the U groove 533. Further, two props 535*a* and 535*b* are provided at the camber 532 of positioning portion 53 and the boundary of flange 51. A convex portion 541 is formed at the back-end sides of two wedge flakes 54*a* and 54*b*. The two sides of convex portion

541 stretch beyond the two sides of wedge flakes 54*a* and 54*b* at proper distance of intervals to form an extended portion 5411 and wedge into the receiving grooves 534*a* and 534*b*. A V groove 542 is further formed at each of the front sides of wedge flakes 54*a* and 54*b*. A torsion spring 55 is provided in the U groove 533. The two free ends of torsion spring 55 respectively lean elastically against the opposite inner sides of wedge flakes 54*a* and 54*b* to push open the wedge flakes 54*a* and 54*b*.

Three positioning grooves 61*a*, 61*b*, and 61*c* are formed on the inner circumference of reversible ring 60 and wedge to the positioning unit 511 on the base 50, and thus the reversible ring 60 has a 3-section position capability. Two triangular stoppers 62*a* and 62*b* are provided around the inner circumference of reversible ring 60. The driving portions of wedge flakes 54*a* and 54*b* lean against the opposite inner sides of stoppers 62*a* and 62*b*. When turning, the reversible ring 60 drives the wedge flakes 54*a* and 54*b* to turn around the receiving grooves 534*a* and 534*b*.

A link hole 71 is formed passing through the blind flange 70 and spirally being connected with a screw 73 to the lockhole 5311 on the positioning portion 53 to lock the blind flange 70 onto the positioning portion 53. Two joint grooves 72 are formed at the inner side of blind flange 70 that is opposite to the positioning portion 53 and joint together with the extended portion 5411 of convex portion 541 on each of the wedge flakes 54*a* and 54*b* to make the wedge flakes 54*a* and 54*b* turn securely.

A groove 81 is formed around inside the ratchet 80 and wedged onto a shift limit groove 74 on the blind flange 70 by means of a C ring 82 to fix the ratchet 80 onto the positioning portion 53 and make it overlap with the reversible ring 60. A gear 83 is further provided at the inner side of ratchet 80 to wedge the V grooves 542 of wedge flakes 54*a* and 54*b*. A convex joint 84 is provided at the front side of ratchet 80 to joint a wrench socket 100.

Figure 6A:
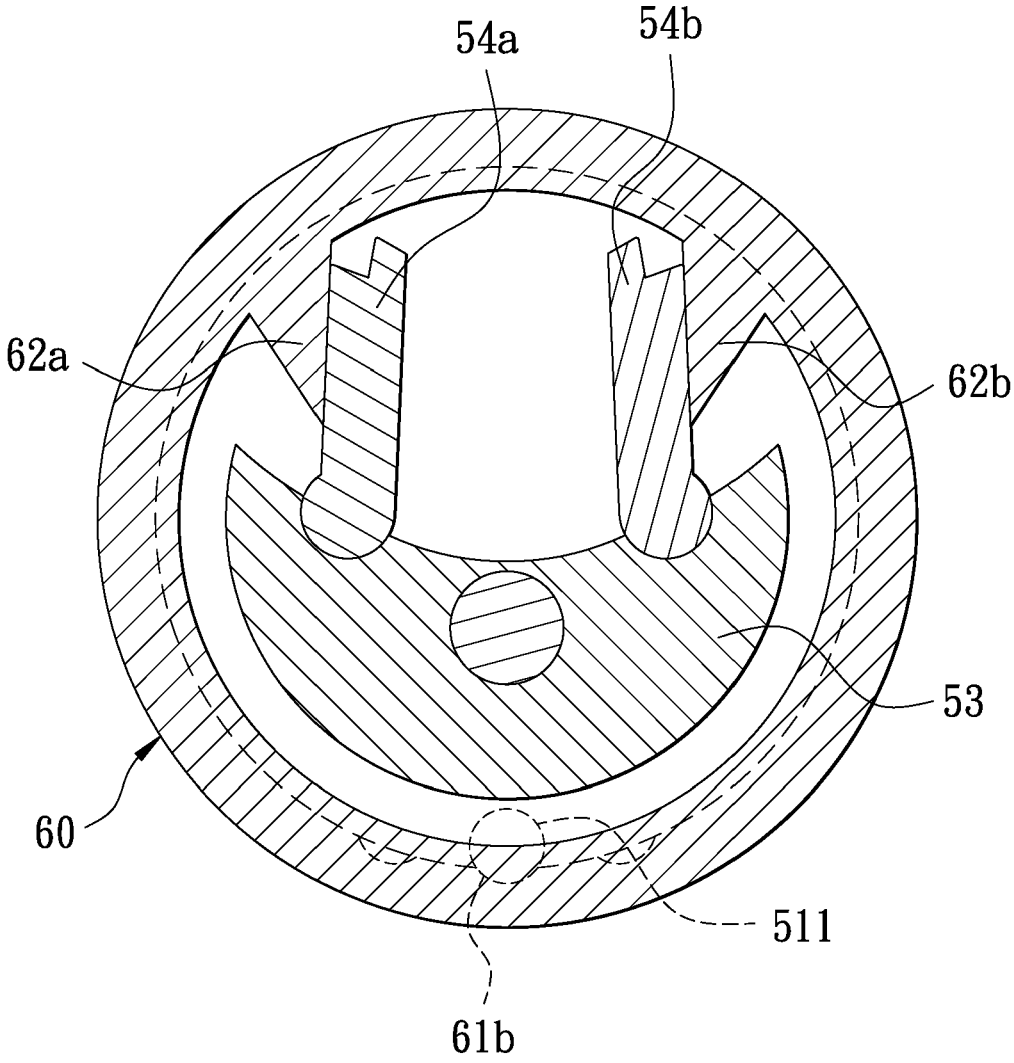
FIGS. 6A and 6B are sectional views of the middle section and front section of the positioning terminal of ratchet tool according to this invention, illustrating a positioning status before a reversible ring turns.
Figure 6B:
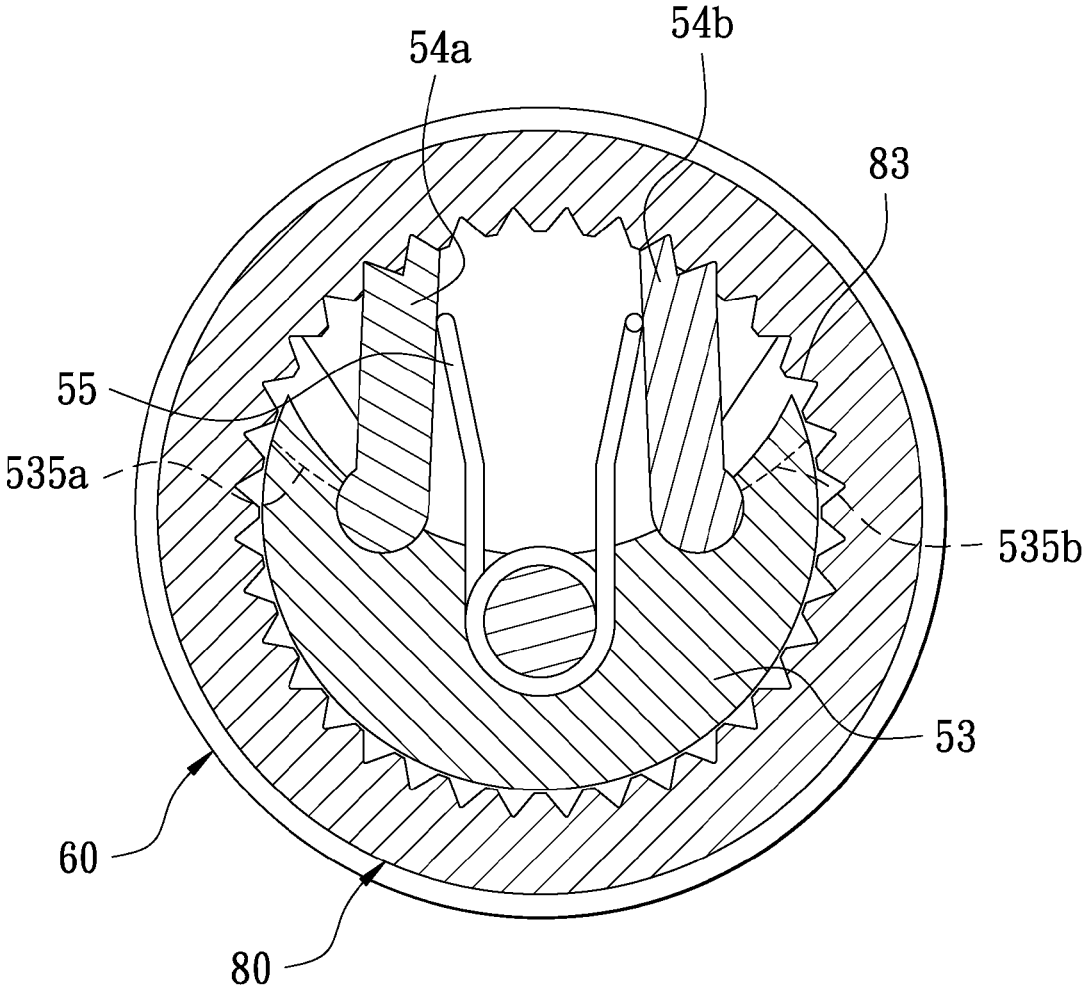

Refer to FIGS. 6A and 6B as sectional views of the middle section and front section of the positioning portion according to this invention, illustrating a positioning status before the reversible ring turns. When the reversible ring 60 stays at an initial site, the positioning unit 511 is wedged into the positioning groove 61*b*. Here, the driving portions of wedge flakes 54*a* and 54*b* are elastically pushed down by the torsion spring 55 to wedge the gear 83 of ratchet 80. Thus, when turning, the grab handle 90 in FIG. 5 may drive the ratchet 80 to work bi-directionally.

Figure 7A:
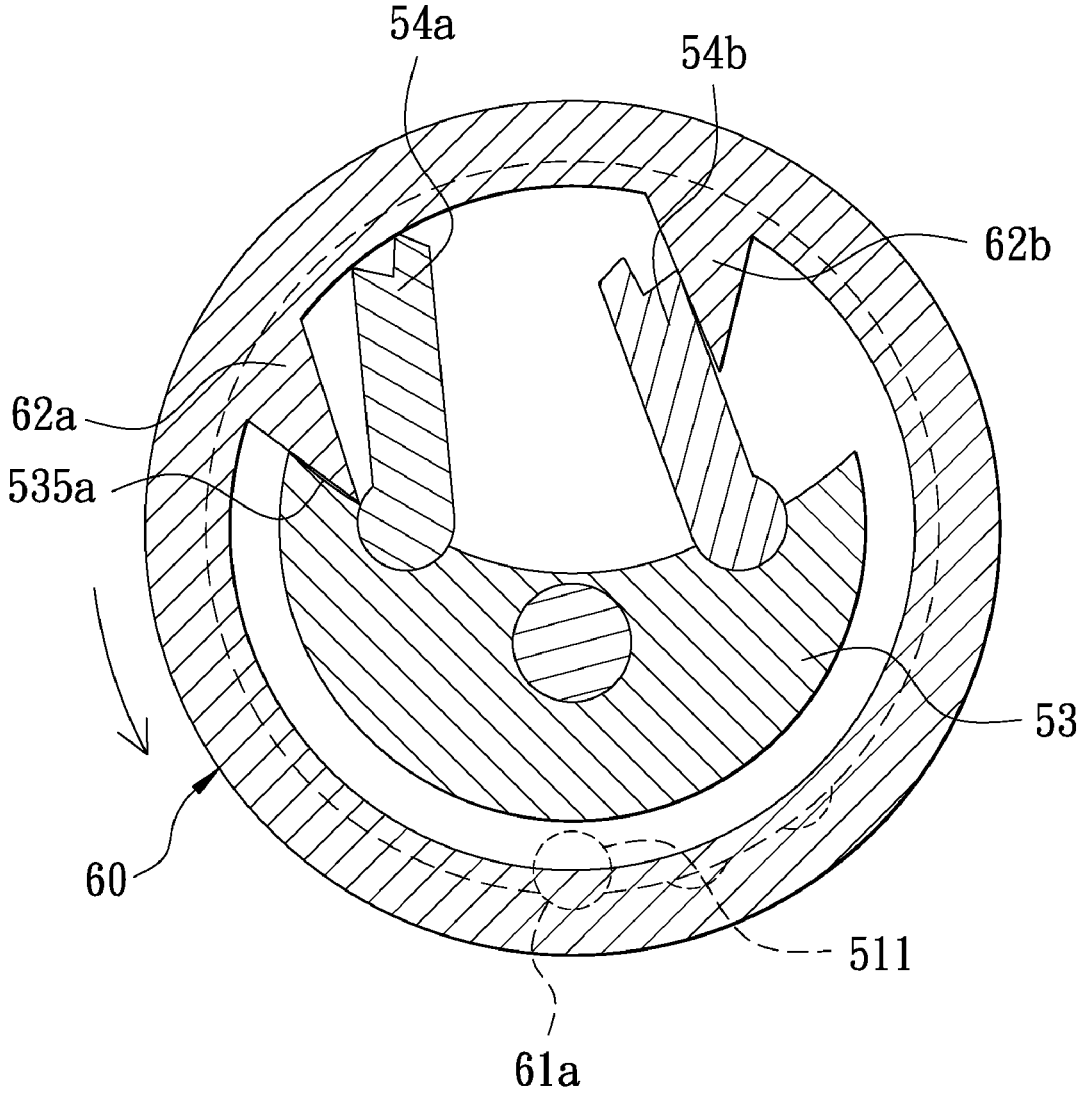
FIGS. 7A and 7B are sectional views of the middle section and front section of the positioning terminal of ratchet tool according to this invention, illustrating a positioning status after a reversible ring turns.
Figure 7B:
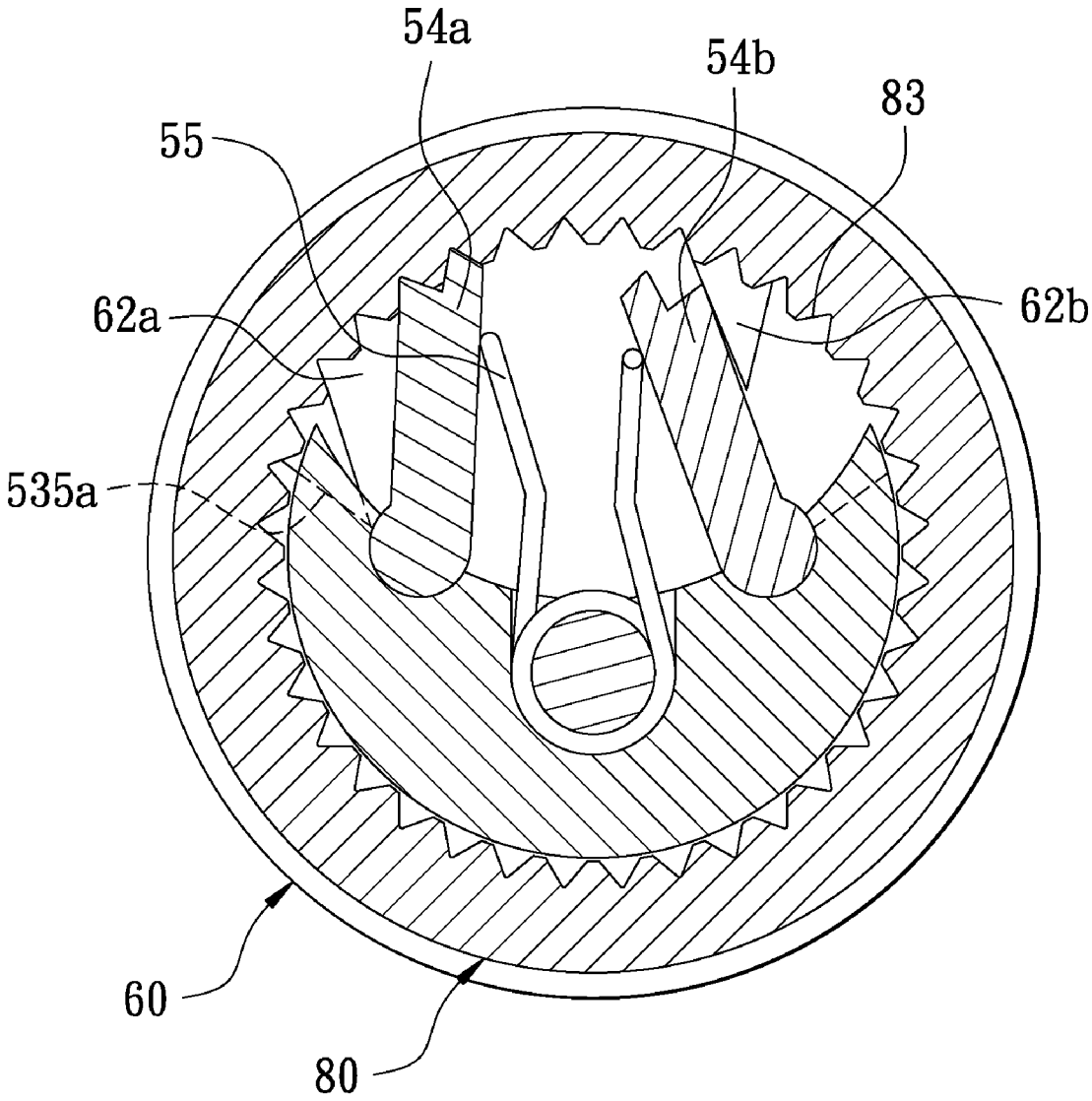

Refer to FIGS. 7A and 7B as sectional views of the middle section and front section of the positioning portion according to this invention, illustrating a positioning status after the reversible ring turns. When turning counterclockwise, the reversible ring 60 drives the stopper 62*a* to stop on the prop 535*a*. Further, the positioning unit 511 is wedged into the positioning groove 61*a*. Here, the stopper 62*b* drives the wedge flake 54*b* to turn at an angle counterclockwise and thus release from the gear 83 of ratchet 80, and then drives the ratchet 80 to release clockwise.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A reversible ratchet tool comprising:

a base;

one end of the base is a positioning portion, a circumference of the positioning portion is formed with an open slot and an inward concave camber;

a U groove with a lockhole is formed in the middle section of the camber;

two receiving grooves are formed at two sides of the U groove, one on each side, and are arranged at a distance of interval, the mouths of the receiving grooves are open in the same direction as the U groove:

two wedge flakes;

each of the wedge flakes is wedged into a respective receiving groove, and an elastic part being provided in the U groove and elastically pushing open the wedge flakes;

a reversible ring set around the positioning portion;

the inner circumference of the reversible ring is formed with three concave positioning grooves;

a positioning unit being wedged between the concave positioning grooves and the positioning portion;

two stoppers, each defined by a triangular projection projecting inwardly toward said mouths, being provided in the inner circumference of the reversible ring, in which the wedge flakes is provided between the stoppers and, when turning in a direction, the reversible ring drives one of the wedge flakes, via one of the stoppers, to turn an angle around the respective receiving groove, wherein two concave props are formed on two respective ends on the camber of positioning portion and, when the reversible ring turns an angle in a direction, one of the stopper stops at a respective prop;

a ratchet being set around the positioning portion and overlapping with the reversible ring, in which a gear is provided at the inner side of ratchet to wedge the wedge flakes;

a convex portion is formed at the back-end sides of wedge flakes to wedge into the receiving grooves and a V groove is formed at the front sides of wedge flakes to fully wedge the gear of ratchet; and a convex joint is provided at the front side of ratchet to join a wrench socket.

2. The reversible ratchet mechanism for ratchet tools according to claim 1, wherein the elastic part is a torsion spring two free ends of which each lean elastically against the opposite inner sides of wedge flakes to push open the wedge flakes.

* * * * *